United States Patent [19]

Jochum et al.

[11] 4,350,224

[45] Sep. 21, 1982

[54] RESCUE SYSTEM ON HIGH RISE BUILDINGS FOR EVACUATING PERSONS IN THE CASE OF FIRE

[75] Inventors: Friedrich Jochum, Kaiserslautern; Ernst Landsberg, Bergisch-Gladbach; Plano Zschernack, Odenthal, all of Fed. Rep. of Germany

[73] Assignee: Walther & Cie Aktiengesellschaft, Cologne, Fed. Rep. of Germany

[21] Appl. No.: 156,635

[22] Filed: Jun. 4, 1980

[30] Foreign Application Priority Data

Jun. 6, 1979 [DE] Fed. Rep. of Germany ..... 2922859

[51] Int. Cl.[3] ..... A62B 1/02; B66B 9/02

[52] U.S. Cl. ..... 182/82; 182/141; 187/6

[58] Field of Search ..... 182/82, 141, 148, 51, 182/52; 187/6

[56] References Cited

U.S. PATENT DOCUMENTS

| | | | |
|---|---|---|---|
| 275,895 | 4/1883 | Eastman | 182/52 |
| 780,711 | 1/1905 | Donnell | 187/6 |
| 786,641 | 4/1905 | Grossmann | 187/6 |
| 1,019,284 | 3/1912 | Taft et al. | 182/51 |
| 2,647,675 | 8/1953 | Bernett | 187/6 |
| 3,945,469 | 3/1976 | Dorcich | 187/6 |
| 4,018,306 | 4/1977 | Lyons | 182/142 |

*Primary Examiner*—Reinaldo P. Machado
*Attorney, Agent, or Firm*—Michael J. Striker

[57] ABSTRACT

A rescue system for a multi-floor building includes an upright climb rail assembled of profiled rail sections defining two lateral cooling channels and an upright tooth rack extending around the entire length of the rail; a rescue cabin includes a projecting frame insertable into a front guiding slot in the rail and supporting a driving gear engaging the upright tooth rack; the frame of the cabin overlaps safety windows provided on each floor of the building and has an entrance opening facing the windows.

13 Claims, 5 Drawing Figures

RESCUE SYSTEM ON HIGH RISE BUILDINGS FOR EVACUATING PERSONS IN THE CASE OF FIRE

BACKGROUND OF THE INVENTION

This invention relates in general to fire escape systems for use in connection with multi-floor structures such as high rise buildings and the like, and in particular to a rescue system including one or more upright guide rails fixedly mounted on a front wall of a building in the range of escape windows of the building to guide a rescue cage which by means of guides and transmission mounts is movably mounted on the guide rail to move up and down to the level of the escape windows on respective floors.

The rescue systems of this type has the advantage in providing relatively inexpensive and durable means for a comfortable and reliable rescue of persons from a burning high rise building where the application of normally available fire ladders is impossible or impractical. An additional advantage of this system is in the fact that it enables the firemen to enter without obstacles in the interior of the burning building and to evacuate the persons even from the highest floors.

A rescue device of this kind is known, for example, from the German Pat. No. 67,409 disclosing two pipes secured at a distance from one another to an outer wall of the building. Inside each pipe is guided via rollers, a looped cable connected to pistons movable in the respective pipes. Each piston is connected through a longitudinal slot in the pipe to a rescue gondola. The gondola pertaining to one pipe is moved in an opposite direction with respect to the gondola guided in the other pipe, i.e. the gondola occupied by the rescued persons slides downwardly and is controlled by means of a breaking device whereas the second empty gondola is moving upwardly.

A reliable rescue operation on all floors of the burning building, however, is impossible by means of this prior art device.

In another rescue device described in German Pat. No. 163,588 the above disadvantage is avoided in the provision of a rescue cage which is guided on rails secured to a building and is suspended on a hoist or a pulley drive by means of which it is moved in vertical direction. The hoist, however, has the disadvantage that its cables are exposed to flames from the burning building and consequently the whole rescue equipment is in danger to become unusable.

From the German published patent application No. 2,628,041 it is also known how to arrange a rope or cable hoist at a front wall of the building in such a manner that the rescue cage during its descent is pulled by means of a load cable away from the building wall. Even this arrangement is unsuitable for use at high rise buildings inasmuch as the lower deverting point for the load cable would have to be arranged at an excessively large distance from the building. At narrow building sites such as, for example, in New York City there is not sufficient room for a device of this type.

Another prior art device for rescuing endangered persons from a building in the case if fire is described in the German published patent application No. 2,447,030 and teaches a building with a balcony on each floor provided on its lateral side with a rescue gondola which in the case of a fire is swung via linking elements against the wall of the building and by means of its arresting claw is brought into engagement with a guide rail secured to the wall. The arresting claw acts as a brake of the gondola during its downward movement by gravity.

The disadvantage of this system is the fact that the rescue gondola cannot be used twice and consequently any person which may be left behind on the floor from which the rescue gondola has been removed can no longer be rescued. Another disadvantage of this prior art device is to be seen also in the fact that it is impossible to employ several rescue gondolas simultaneously because they will interfere with one another and in the lower range of the building they would keep one upon the other and from the uppermost gondola the rescued persons could step out only with difficulty.

In addition, it is also known to employ mobile, telescopically extendable ladders and also ladder systems fixedly mounted to the front wall of the building. Such ladders, however, are applicable to a limited height only, approximately to the maximum height of about 30 meters.

External elevators separated from the housing or the so-called escape towers have been also devised but they are very expensive, require a relatively large space and from the architectural point of view are very disadvantageous.

SUMMARY OF THE INVENTION

It is therefore a general object of the present invention to overcome the aforementioned disadvantages.

More particularly, it is an object of the invention to provide and improved fire escape system which is not possessed of these disadvantages.

Another object of this invention is to provide a fire escape system which operates independently from the outer power sources and consequently insures a high security and reliability of operation.

In keeping with these objects, and others which will become apparent hereafter, one feature of this invention resides, in a rescue system for evacuating persons from a multi-floor structure having a wall provided with at least one rescue window on each floor, in the provision of an upright climb rail secured to the wall near to the rescue windows, and a rescue cabin having at least one inlet arranged opposite the area of the rescue windows, transmission and guide elements engaging the rail, and a local driving motor coupled to the transmission elements to impart and upward and downward movements to the cabin on the rail.

In highrise buildings according to standard building rules, the staircases connecting respective floors have to be constructed as fireproof spaces in order to provide for safe escape routes for the endangered persons. The safety against fire of the staircases, however, in many cases is insufficient inasmuch already in a short time after the fire starts the fireproof routes fill up with dense smoke which interrupts the escape paths.

The rescue system according to this invention is arranged so that fireproof space or staircase on each floor is provided with a rescue window through which the endangered persons can escape into the movable rescue cabin. Since the rescue cabin is provided with a local drive which is independent from the energy source inside the building, it is achieved that the rescue system of this invention can continue its operation by means of an emergency power aggregate when the power source inside the building fails to function. It is of advantage when an electric local drive is employed because the rescue team such as firemen, technical auxiliary service crew and the like can readily take along an electric power generator and connect the same to the rescue cabin. The local drive for the cabin, however, can be made not only as an electrical drive but also a hydraulical or pneumatical one. It is necessary only to insure a fire resistant installation of such hydraulic or pneumatic driving means.

The arrangement of the rescue cabin opposite the range of the fire proof spaces such as staircases or so-called fireproof cells, has the advantage that in the case of a fire, the endangered persons can locate such fireproof spaces by means of conventional optical or acoustical guiding signals and wait in the fireproof spaces without encountering any major danger until they are rescued by the cabin of this invention.

This arrangement is of particular advantage in large office buildings where several hundred employees work on each floor and the optical or acoustical guiding system insures that all persons in the case of a fire will find their way into the fireproof spaces where will wait until their rescue.

The apartments and office spaces in the buildings include usually inflammable articles and consequently the apartments and offices cannot counted among the fireproof spaces. For this reason the guide and climb rails should not be arranged in the range of the apartments and office spaces, particularly when the system of this invention is additionally applied to existent highrise buildings.

A substantial advantage of the system of this invention resides particularly in its capability to be installed in a very simple and inexpensive manner on existing highrise buildings. When guide and climb rail is to be additionally mounted to a structure, it is necessary to consider the static conditions of the structure. In order to insure the safety and the reliability of the rescue device of this invention, the guide and climb rail has to be secured to the frame of the building and not only to the brick walls or to the outer lining of the front wall. Already during the installation of the guide or climb rail, the latter can be most simple means such as by painting or by the addition of supplemental profiles, be suitably adjusted to the architecture of the building.

The guide and climb rail is shaped to define a hollow profile with a gap for accommodating the guide and transmission elements of the drive of the rescue cabin and also for accommodating a system of pipes which are connectable to a public water supply in order to insure that even in the case of a large fire sufficient cooling and thus functional reliability of the rescue cabin be maintained. An additional connection piece or pipe accessible from the outside and opening into the hollow spaces of the guide and climb rail offers an additional possibility for the rescue team to couple by means of hoses the rail to the nearest street hydrant. In addition, the guide and climb rail is connected to the building wall in such a manner that it is extensible in its longitudinal direction, and therefore even in the case of a large fire developing a very high temperature, the stability of the guide and climb rail together with its transmission and guiding elements remains unaffected.

The cooling of the guide and climb rail is particularly important when the rescue cabin is coupled to the guide and climb rail by means of a gear pinion engaging an upright tooth rack in the interior of the rail.

The connection of the rescue cabin to the guide and climb rail is to be such that the cabin is capable of being quickly and reliably connected to or disconnected from the rail. The system of this invention offers the advantage that when employing a mobile rescue cabin it is unnecessary to equip each building having the standard guide and climb rail with its own rescue cabin. The cabin can be transported to the site of fire by the rescue team and readily attached to the existent guide and climb rail, and driven by a separate electric power aggregate also transported to the place of fire. In this manner it is possible to reduce the number of rescue cabins attached to each building and the appearance of the outer walls of the building is improved. The appearance of the front wall would also be improved in such a manner that the rescue cabin is normally stored in a covered underground compartment from which it is removed only in the case of fire.

As mentioned above, it is not always possible to prevent the fireproof staircases in the building from being filled with dense smoke. In order to prevent, however, the entry of smoke in the rescue cabin, the latter is constructed in a fireproof fashion on its lower part only so as to protect the cabin against high flames eminating from the nearby windows. The upper part of the cabin, however, is in the form of a grate so that dense smoke can escape. Both the rescue cabin and the fireproof space are equipped with sufficient amount of the so-called instant rescue appliances such as, oxygen masks and the like in order to provide for an additional protection of the endangered persons.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
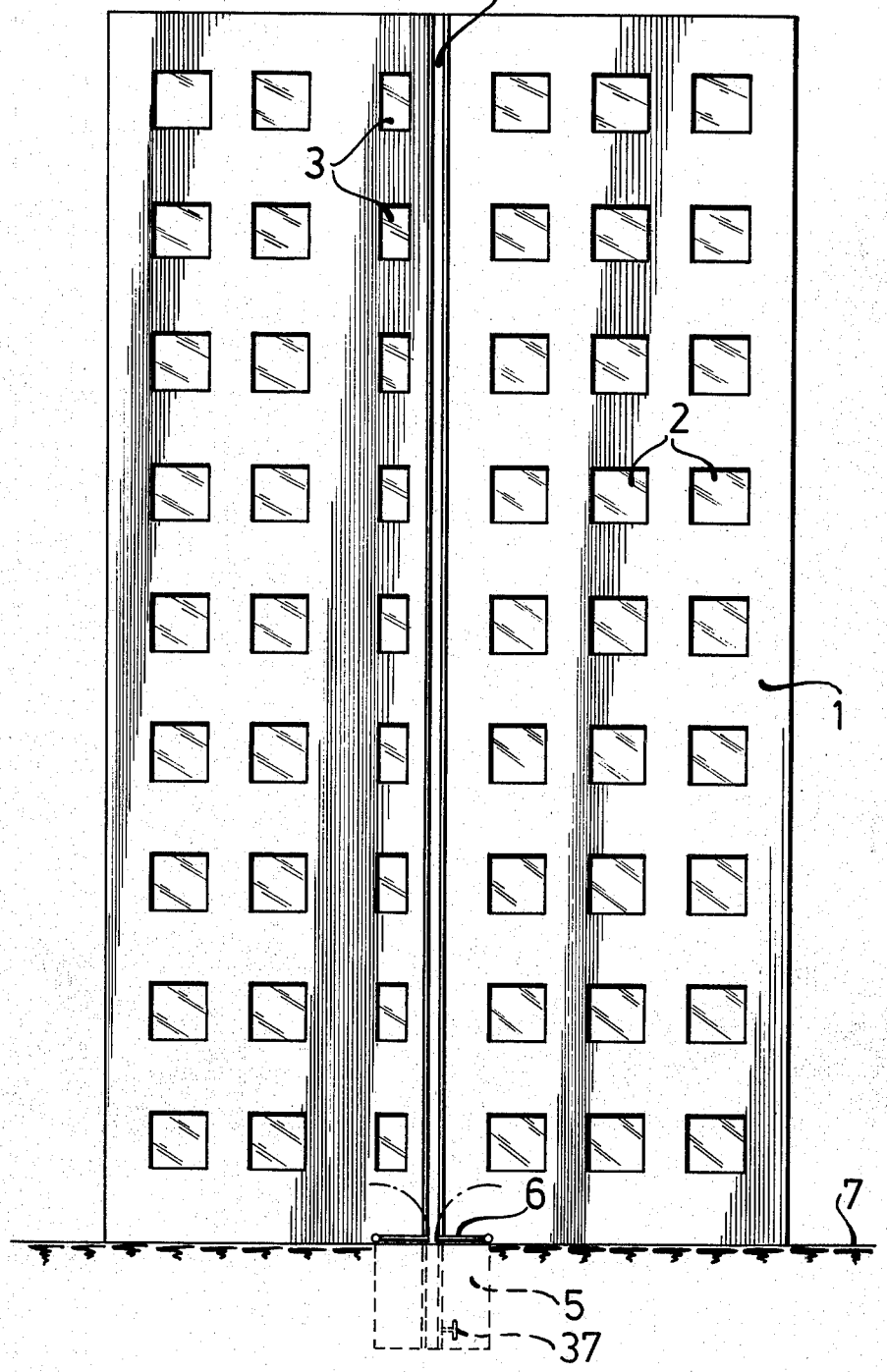
FIG. 1 is an elevation view of a highrise building provided on its front wall with a guide and climb rail.
Figure 3:
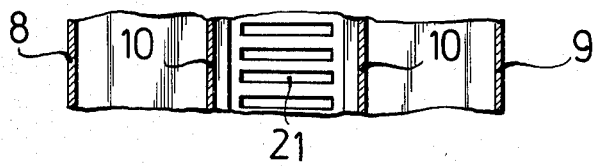
FIG. 3 is a sectional elevation view of a cutaway portion of the rail of FIG. 2 taken along the line A—B.

Referring to FIG. 1, a multifloor building 1 has on each floor a plurality of apartment or office windows and in addition is provided with safety or rescue windows leading to fireproof spaces such as staircases. Near to the range of the safety windows 3, a guide and climb rail 4 is secured to the frame of the building and extends from the top of the building 1 to an underground compartment 5 below the level of the sidewalk 7. The underground compartment 5 is covered by means of hinged doors 6.

Figure 2:
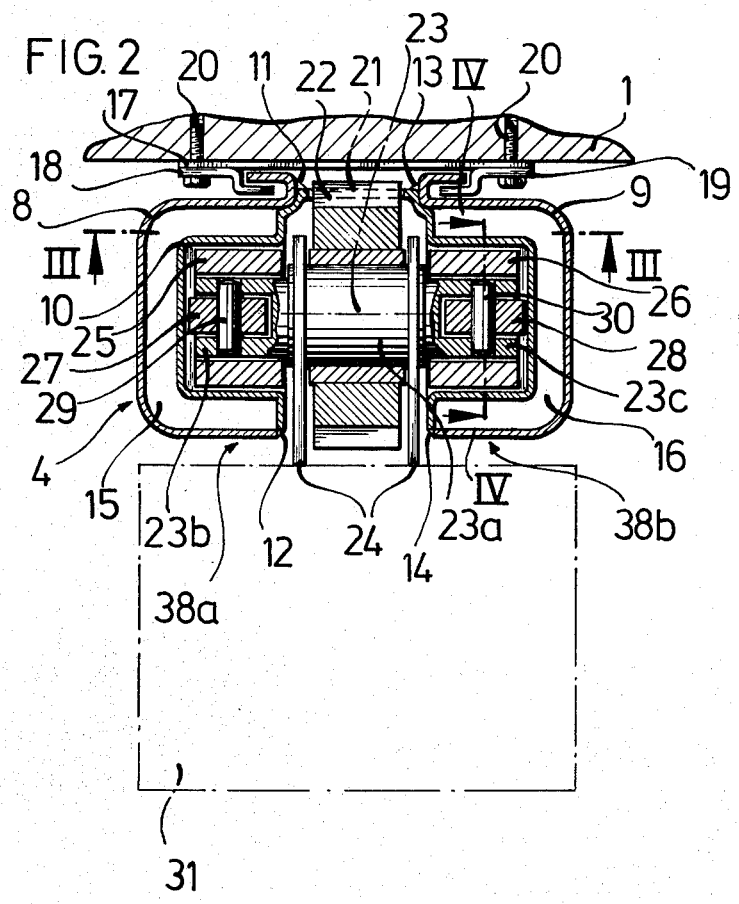
FIG. 2 is a sectional top view of the guide and climb rail.
Figure 4:
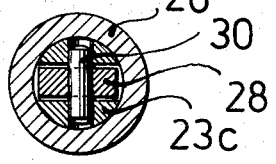
FIG. 4 is a sectional side view of the rail of FIG. 2 taken along the line C—D.

As seen from FIG. 2, the guide and climb rail 4 is assembled of profiled multiple-part rail sections, namely of a shaped inner rail section 10 and two outer rail sections 8 and 9. All rail sections are rigidly connected one to another by welded joints 11 through 14 so as to form two lateral channels or chambers 15 and 16, each having a U-shaped cross-section. The rear end portion of respective outer rail sections 8 and 9 are bent into a U-shape which slidably engages holding and mounting brackets 18 and 19 on the front wall of the building. The brackets 18 and 19 are interconnected by a glide plate 17 and secured to building 1 by anchoring bolts 20. The center range of the inner rail section 10 between the welded joints 11 and 13 is formed into the shape of a tooth rack 21 which engages a driving pinion or gear 22 in the rescue cabin 32. The driving gear 22 is supported for rotation on a center portion 23*a* of an axle 23 the end portions of which are rigidly connected to a projecting support frame 24 of the rescue cabin 32. The end portions of the axle 23 are in the form of laterally projecting stubs 23*b* and 23*c* each supporting guide elements for guiding the rescue cabin 32 in the rail 4. These guide elements include guide rollers 25 and 26 supported for rotation on the stubs and cooperating with the U-shaped inner surfaces of the rail section 10 which extend parallel to the front wall of the building 1 and form the recessed walls of the upright U-shaped cooling chambers 15 and 16. In order that the supporting frame 24 be guided also at right angles to the plane of the rollers 25 and 26, the ends of the stubs 23*b* and 23*c* are formed with recesses for accommodating guide wheels 27 and 28 which are supported for rotation on pins 29 mounted in the stubs. The guide wheels 27 and 28 engage therefore the inner surface portions of the rail section 10 extending at right angles to the front wall of the housing 1. The driving pinion of gear 22 is driven by a (schematically illustrated) driving unit 31 connected to the supporting frame 24. The driving unit 31 includes transmission gears engaging the driving pinion 22 and an electromotor, or a hydraulic motor and the like, for driving the transmission gears.

Figure 5:
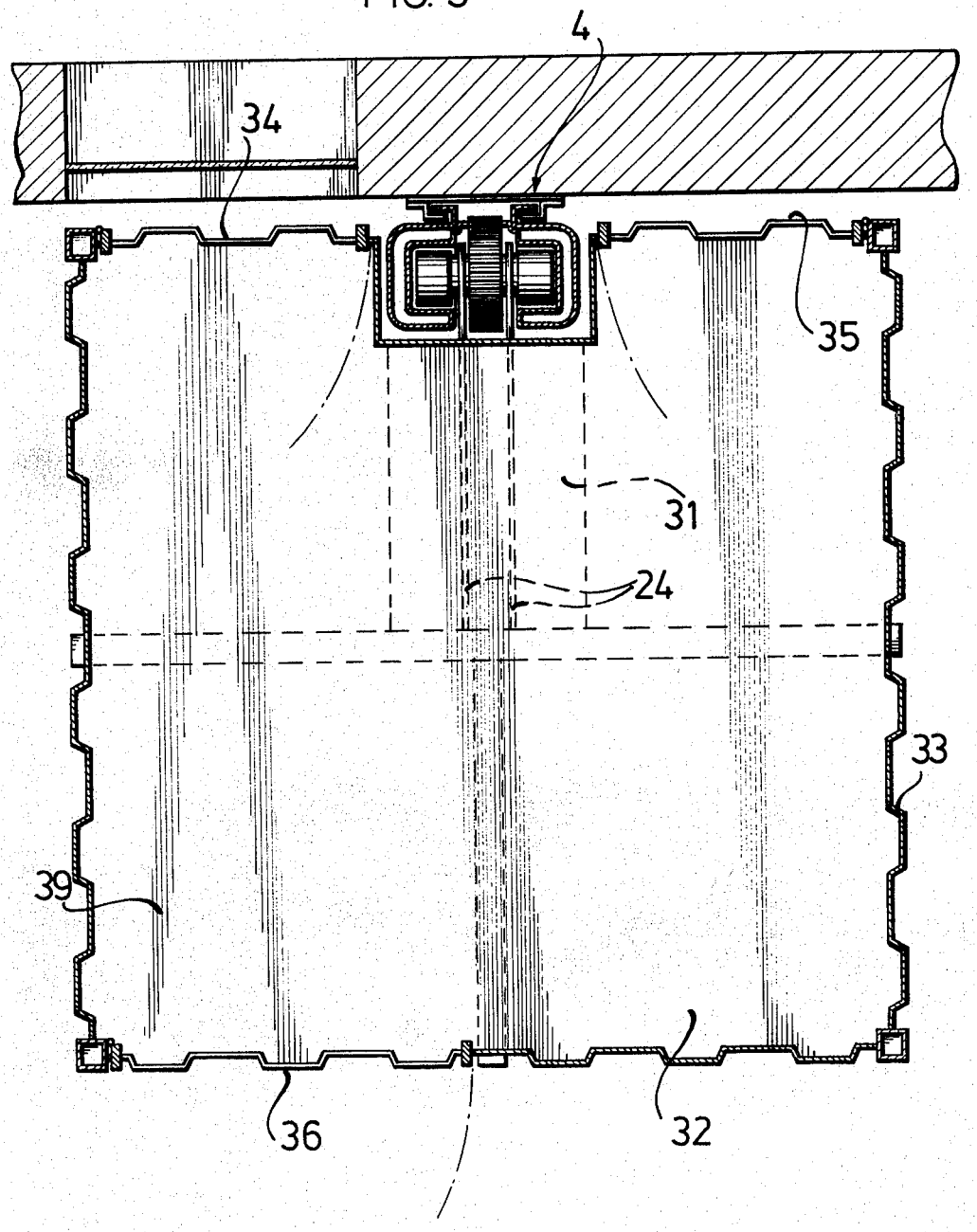
FIG. 5 is a schematic top view, partly in section of the rescue cabin of this invention.

The rescue cabin 32 schematically illustrated in FIG. 5 is formed by side walls 33 overlapping the range of the safety windows 3. The side wall of the cabin which faces the front surface of the building is formed with inlet or entrance openings 34 and 35. If desired, the entrance openings can be equipped with protective doors. The floor of the cabin is indicated by reference numeral 39. The driving unit 31 with its supporting frame 24 which projects into the longitudinal guiding slot or gap formed in the climb rail 4 is secured to a bottom frame supporting the cabin floor 39 or it can be also secured to a non-illustrated frame forming the roof of the cabin. The cooling chambers 15 and 16 are connectable to a non-illustrated water supply circuit. Preferably the lowermost part of the guide rail 4 (FIG. 1) is provided with an additional connecting pipe 37 through which in the case of a fire the firemen connect by means of a hose an external source of cooling water. For example, the pipe connection 37 can be connected to a nearby street hydrant.

The overlapping connection of the U-shaped end portions of the outer rail sections 8 and 9 with the holding brackets 18 secured to the front wall of the building 1 has the effect that the climb rail 4 is movably mounted relative to the slide plate 17 and consequently no tensions can arise in the rail 4 even if the latter is exposed to the heat from a fire. In order to exchange the rescue cabins and to enable a fast and trouble-free insertion of the guide elements 25, 26, 27 and 28 as well as transition elements 22, 23 and 24 into the guide and climb rail 4, the outer arms 38*a* and 38*b* at the lower range of the U-shaped cooling chambers 15 and 16 are provided at with recesses or cutouts through which the axle stubs with guide rollers 25 and 26 are inserted into the inner guiding channels of the rail while the driving pinion 22 engages the teeth of the upright rack 21. Preferably these insertion recesses are formed in the range of the underground compartment 5 or above the surface of the sidewalk 7.

As soon as the guide transmission elements 22–31 are inserted into the inner guiding channels of rail 4, the cabin is slightly lifted so that the coupling of the guiding and transmission elements of the cabin to the guide and climb rail 4 is completed. If the rescue cabin 32 is intended to be permanently coupled to the guide and climb rail 4, the insertion recesses 38*a* and 38*b* can be dispensed with. If these recesses, however, are located in the range of the underground compartment 5, there has to be provided a stop member which ensures that the cabin 32 is stopped a small distance above the insertion recesses 38*a* and 38*b* in order to prevent an unintended disengagement of the cabin from the rail 4.

As mentioned previously, it is not necessary that each building be also equipped with its own rescue cabin and the guiding and climbing devices 22–31. It is possible instead to store such rescue cabins at the fire station and only in the case of a fire they are transported and coupled to the rail 4. Upon the rescue of the persons from the burning building, the rescue cabin 32 can be also used by firemen for extinguishing the fire and thereafter the rescue cabin is again retransported to the fire station.

It will be noted that each of the elements discussed above, or two or more together, may also find a useful application in other types of constructions differing from the types described above.

While the invention has been illustrated and described as embodied in a rescue system for use in connection with high rise buildings, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fiarly constitute essential characteristics of the generic or specific aspects of this invention.

What is claimed as new and desired to be protected by Letters Patent is set forth in the appended claims:

1. A rescue system for evacuating persons from a multi-floor structure such as a high-rise building and the like, having a wall provided with at least one rescue window on each floor, comprising an upright climb rail secured to said wall in the range of said windows; a rescue cabin having transmission and guide elements for engaging said rail a driving motor attached to said transmission elements to drive said cabin upwardly and downwardly along said rail, and cabin walls provided with at least one entrance opening facing the rescue windows on respective floors; said upright climb rail being slidably connected to said wall of the building to compensate for longitudinal extensions, and being assembled of a profiled inner rail section and two outer rail sections rigidly connected to said inner rail section and forming therewith two lateral cooling chambers.

2. A rescue system as defined in claim 1 further including a mobile power source for energizing said driving motor, said power source being independent from the source of energy inside the building.

3. A rescue system as defined in claim 2 wherein the driving motor is an electromotor and said independent power source is a mobile electrical current generating aggregate.

4. A rescue system as defined in claim 1 wherein said multi-floor structure includes on each floor a fireproof space communicating with said rescue window, and an optical or acoustical guiding system for directing the endangered persons into said fireproof space.

5. A rescue system as defined in claim 1 wherein said upright climb rail includes at least one cooling chamber extending along the entire length of the rail for receiving a cooling liquid.

6. A rescue system as defined in claim 5 wherein said cooling chamber is provided with a connection pipe connectable to an outer source of cooling liquid.

7. A rescue system as defined in claim 1 wherein said cooling chambers have respectively a U-shaped cross section and are spaced apart one from the other to define lateral guiding channels for said transmission and guiding elements of the cabin.

8. A rescue system as defined in claim 7 wherein said sections are made of a corrosion-resistant material.

9. A rescue system as defined in claim 8 wherein said rail is made of a corrosion-resistant steel.

10. A rescue system as defined in claim 7 said cooling chambers define a front guiding gap therebetween and are provided at their lower range with recesses for the insertion and alternatively the withdrawal of said guiding and transmission elements into or from said guiding channels.

11. A rescue system as defined in claim 10 wherein said rescue cabin has a fireproof structure provided with ventilation means.

12. A rescue system as defined in claim 11 wherein said rescue cabin includes a supporting frame projecting into said front guiding gap of said climb rail and supporting said transmission and guiding elements, said cabin walls each having a closed lower portion and a grate-like upper portion and further including a grate-like roof.

13. A rescue system as defined in claim 1 further including an underground compartment covered by hinged doors, said climb rail extending into said compartment and said rescue cabin being normally stored in said compartment in a permanent connection with said climb rail.

* * * * *